US010137053B2

(12) United States Patent
Sone et al.

(10) Patent No.: US 10,137,053 B2
(45) Date of Patent: Nov. 27, 2018

(54) MASSAGE APPARATUS

(71) Applicant: DAITO ELECTRIC MACHINE INDUSTRY COMPANY LIMITED, Higashi-Osaka-shi, Osaka (JP)

(72) Inventors: Yasushi Sone, Higashi-Osaka (JP); Shinsaku Shimizu, Higashi-Osaka (JP); Zhenhai Zhang, Higashi-Osaka (JP)

(73) Assignee: DAITO ELECTRIC MACHINE INDUSTRY COMPANY LIMITED, Higashi-Osaka-Shi, Osaka (JP)

( * ) Notice: Subject to any disclaimer, the term of this patent is extended or adjusted under 35 U.S.C. 154(b) by 717 days.

(21) Appl. No.: 14/443,096

(22) PCT Filed: Oct. 18, 2013

(86) PCT No.: PCT/JP2013/078308
§ 371 (c)(1),
(2) Date: May 15, 2015

(87) PCT Pub. No.: WO2015/019509
PCT Pub. Date: Feb. 12, 2015

(65) Prior Publication Data

US 2015/0305968 A1 Oct. 29, 2015

(30) Foreign Application Priority Data

Aug. 6, 2013 (JP) ..... 2013-163241

(51) Int. Cl.
*A61H 15/00* (2006.01)
*A61H 7/00* (2006.01)

(52) U.S. Cl.
CPC ..... *A61H 15/00* (2013.01); *A61H 7/007* (2013.01); *A61H 15/0078* (2013.01);
(Continued)

(58) Field of Classification Search
CPC .... A61H 15/00; A61H 7/007; A61H 15/0078; A61H 2201/1654; A61H 2205/086;
(Continued)

(56) References Cited

U.S. PATENT DOCUMENTS 3,835,844 A * 9/1974 Lang ..... A61H 23/0218 601/128
5,934,748 A * 8/1999 Faust ..... B60N 2/5635 297/180.1
(Continued)

FOREIGN PATENT DOCUMENTS

CN 201185780 Y 1/2009
CN 201227393 Y 4/2009
(Continued)

OTHER PUBLICATIONS

English translation for JP-2011-61925, J-platpat.inpit.go.jp, Nov. 27, 2017.*
(Continued)

*Primary Examiner* — Rachel T Sippel
*Assistant Examiner* — Tu Vo
(74) *Attorney, Agent, or Firm* — Birch, Stewart, Kolasch & Birch, LLP

(57) ABSTRACT

A massage apparatus in which both a massage mechanism and a warm-cool air supply section are housed inside a backrest. The massage apparatus includes a backrest for supporting a user's back; and a massage mechanism disposed inside the backrest for producing massage action on user's back. The backrest has a front side with a two-layer structure. A warm-cool air supply section is provided that is capable of feeding warm or cool air into an interlayer region of the two-layer structure. The massage mechanism can be moved up and down along the lengthwise direction of the backrest. The warm-cool air supply section is located out-
(Continued)

side of a movement area which is the range of up-and-down movement of the massage mechanism.

4 Claims, 8 Drawing Sheets

(52) U.S. Cl.
CPC ..... *A61H 2015/0014* (2013.01); *A61H 2201/0149* (2013.01); *A61H 2201/025* (2013.01); *A61H 2201/0207* (2013.01); *A61H 2201/0214* (2013.01); *A61H 2201/1623* (2013.01); *A61H 2201/1654* (2013.01); *A61H 2201/1669* (2013.01); *A61H 2205/081* (2013.01); *A61H 2205/086* (2013.01)

(58) Field of Classification Search
CPC ..... A61H 2201/025; A61H 2205/081; A61H 2201/0149; A61H 2201/1623; A61H 2201/1669; A61H 15/02; A61H 2201/02; A61H 2201/0207; A61H 2201/0214; A61H 2201/0221; A61H 2015/0007; A61H 2015/0014; A61H 2015/0021; A61H 2015/0028; A61H 2015/0035; A61H 2015/0042; A61H 2015/005; A61H 2015/0057; A61H 2015/0064; A61H 7/001; A61H 7/002; A61H 7/00; A61H 7/008
See application file for complete search history.

(56) References Cited

U.S. PATENT DOCUMENTS 6,003,950 A * 12/1999 Larsson ..... A47C 7/74 297/180.13
6,186,592 B1 * 2/2001 Orizaris ..... B60N 2/5635 297/180.12
6,224,150 B1 * 5/2001 Eksin ..... B60N 2/5635 297/180.1
6,542,779 B1 4/2003 Lee
7,083,227 B2 * 8/2006 Brennan ..... A47C 7/74 297/180.14
7,201,441 B2 * 4/2007 Stoewe ..... B60N 2/5635 297/180.1
7,213,876 B2 * 5/2007 Stoewe ..... B60N 2/5635 297/180.1
7,261,371 B2 * 8/2007 Thunissen ..... B60N 2/56 297/180.14
7,478,869 B2 * 1/2009 Lazanja ..... B60N 2/5635 297/180.13
7,587,901 B2 * 9/2009 Petrovski ..... A47C 7/74 62/3.3
7,640,754 B2 * 1/2010 Wolas ..... B60N 2/5635 62/3.2
7,827,805 B2 * 11/2010 Comiskey ..... B60N 2/5635 62/244
7,862,113 B2 * 1/2011 Knoll ..... B60N 2/5635 297/180.13
7,877,827 B2 * 2/2011 Marquette ..... A47C 21/044 5/423
8,065,763 B2 * 11/2011 Brykalski ..... A47C 21/048 5/423
8,167,368 B2 * 5/2012 Eckel ..... B60H 1/00285 297/180.13
8,181,290 B2 * 5/2012 Brykalski ..... A47C 21/044 5/423
9,105,808 B2 * 8/2015 Petrovski ..... B60N 2/5628
2002/0067058 A1 * 6/2002 Pfahler ..... A47C 7/744 297/180.11
2003/0102699 A1 * 6/2003 Aoki ..... B60H 1/00285 297/180.14
2003/0212352 A1 * 11/2003 Kahn ..... A61H 1/008 601/98
2004/0060107 A1 * 4/2004 Eisenberg ..... A47K 7/046 4/605
2006/0142676 A1 * 6/2006 Fujii ..... A61H 9/0078 601/98
2007/0084220 A1 * 4/2007 Asada ..... B60N 2/448 62/3.61
2008/0036249 A1 * 2/2008 Heckmann ..... B60H 1/00407 297/180.13
2008/0223841 A1 * 9/2008 Lofy ..... H05B 3/16 219/202
2010/0318004 A1 * 12/2010 Numata ..... A61H 7/007 601/16
2011/0105964 A1 5/2011 Ferber et al.
2012/0172768 A1 7/2012 Ikebe et al.
2012/0319439 A1 * 12/2012 Lofy ..... B60N 2/5657 297/180.1
2014/0110978 A1 * 4/2014 Schneider ..... A61G 5/10 297/180.1
2015/0305968 A1 10/2015 Sone et al.

FOREIGN PATENT DOCUMENTS

CN 101530369 A 9/2009
CN 101909574 A 12/2010
CN 203591421 U 5/2014
EP 1415633 A1 5/2004
JP 10-80454 A 3/1998
JP 2001-61925 A 3/2001
JP 2001061925 A * 3/2001
JP 2008-253559 A 10/2008
JP 2009-268628 A 11/2009
JP 2009-297350 A 12/2009
JP 2011-250837 A 12/2011
JP 2013-66508 A 4/2013
JP 2013-70857 A 4/2013

OTHER PUBLICATIONS

International Search Report, issued in PCT/JP2013/078308, dated Dec. 10, 2013.

* cited by examiner

MASSAGE APPARATUS

CROSS REFERENCE TO RELATED APPLICATIONS

This application is the National Phase of PCT/JP2013/078308 filed on Oct. 18, 2013 which claims priority under 35 U.S.C. 119(a) to Japanese Patent Application No. JP 2013-163241 filed Aug. 6, 2013, all of which are hereby expressly incorporated by reference into the present application.

TECHNICAL FIELD

The present invention relates to a mountable massage apparatus which is used in a condition of being mounted in a chair or the like.

BACKGROUND ART

Various types of massage equipment in which a user is able to sits for receiving a massage (chair-type massage equipment) have been developed to date. There is a heretofore known massage apparatus of this type that comprises a seat and a backrest mounted at the rear end of the seat, and further includes a massage mechanism for imparting at least one of kneading massage action, tapping massage action, finger-pressure massage action, and vibratory massage action to the backrest. Such a massage apparatus is capable of performing an efficacious massage on a body part to be massaged of a user sitting on the seat between the nape and waist regions, viz., the entire back (hereafter referred to as "back side") of the user.

Among such massage apparatuses as above described, in an attempt to meet one of user's demands, there has been developed a massage apparatus capable of warming up and cooling down a to-be-massaged part of user's back side by means of a warm-cool air supply section provided in its backrest (refer to Patent literature 1, for example). More specifically, in such a massage apparatus, a front cover body and a back cover body are arranged in overlapping relation with each other on the surface side of the backrest, and, warm air and cool air can be fed into a space created between the front cover body and the back cover body from the warm-cool air supply section disposed at the back side of the backrest. Moreover, the back cover body is impervious to air, whereas the front cover body has permeability to air, and therefore, warm air and cool air accumulated in the space between the front cover body and the back cover body are fed, through the air-permeable front cover body, to user's back side. Thus, user's back can be warmed up and cooled down by exploiting warm air and cool air that have passed through the front cover body.

Moreover, in the massage apparatus having the warm-cool air supply function as above described, a massage mechanism for massaging a to-be-massaged body part of a user is disposed immediately on the back (rear) side of the back cover body. This massage mechanism has a massager protruding toward a user, so that a to-be-massaged part of user's back can be massaged, while being warmed up and cooled down, by pressing action of the protruding massager exerted from above the two cover bodies, namely the front cover body and the back cover body.

Accordingly, with the massage apparatus disclosed in Patent literature 1, in winter months for example, a user is able to massage his/her desired body part to be massaged while warming up the part, and, on the other hand, in summer season or after taking a bath, a user is able to have a comfortable massage while cooling his/her upper body down.

PRIOR ART REFERENCE

Patent Literature

Patent literature 1: Japanese Unexamined Patent Publication JP-A 2009-297350

SUMMARY OF THE INVENTION

Problems to be Solved by the Invention

In the massage apparatus disclosed in Patent literature 1, since the backrest has a certain level of thickness in a front-rear direction, it is possible to secure a relatively large space inside the backrest. That is, in the massage apparatus disclosed in Patent literature 1, a sufficient space can be secured inside the backrest. This makes it possible to accomplish, in addition to the installation of the massage mechanism, further installation of a heater, a fan, piping, and so forth constituting the warm-cool air supply section at the rear of the warm-cool air supply section in the backrest.

However, among the aforestated massage apparatuses, some are of a type which becomes usable after being mounted on the seat surface of, for example, an ordinary reclining chair or a sofa. Such a massage apparatus is attached to a chair having a size suitable for the seating of a user before use, wherefore too large a thickness of the massage apparatus may lead to user's discomfort in sitting. In this regard, such a massage apparatus is based on a backrest or a seat surface in the form of a thin plate whose thickness is small in the front-rear direction, such as a "legless chair" or a "child car safety seat".

However, in the case of adopting a backrest or a seat surface in the form of a thin plate whose thickness is small in the front-rear direction for such a massage apparatus, a sufficient space cannot be secured inside the backrest or seat, with consequent difficulty in proper storage of the massage mechanism and the warm-cool air supply section together.

The present invention has been devised in view of the problems as mentioned supra, and accordingly its object is to provide a massage apparatus characterized in that both of a massage mechanism and a warm-cool air supply section are housed inside a backrest, and nevertheless the thickness of the backrest, as well as the thickness of a seat, in a front-rear direction can be reduced.

Means for Solving the Problem

In order to accomplish the above object, the following technical means is adopted for the implementation of the present invention.

That is, a massage apparatus pursuant to the present invention comprises: a backrest for supporting user's back; and a massage mechanism disposed inside the backrest for producing massage action on user's back. The backrest has its front side made to have a two-layer structure, and is provided with a warm-cool air supply section capable of feeding warm air or cool air into an interlayer region of the two-layer structure. The massage mechanism can be moved up and down along the direction of length of the backrest. The warm-cool air supply section is located outside of a movement area which is the range of up-and-down movement of the massage mechanism.

It is preferable that the movement area of the massage mechanism is shaped like a long strip elongated in a vertical direction, and that the warm-cool air supply section is disposed on each of the right side and the left side of the movement area.

It is preferable that the warm-cool air supply section is located in a lower part of the movement area.

It is preferable that the two-layer structure comprises a front cover body constituting the front face of the backrest, and a back cover body disposed in a state of overlying the back side of the front cover body, that a space capable of storage of warm air or cool air is created between the front cover body and the back cover body, and that the warm-cool air supply section is connected so as to feed warm air or cool air into the space.

It is preferable that the back cover body is made of a material which is impervious to warm air or cool air supplied from the warm-cool air supply section.

It is preferable that, when the backrest is viewed laterally, the warm-cool air supply section is disposed in overlapping relation with the range of up-and-down movement of the massage mechanism.

It is preferable that the massage apparatus comprises: a platy base plate having the massage mechanism disposed centrally of the forward-facing surface thereof in a widthwise direction for free lengthwise movement; a cover plate shaped like a plate which can overlie the front face of the base plate, and in which that part thereof which corresponds to the movement area of the massage mechanism is formed as an opening; a back cover body attached to the opening of the cover plate; a front cover body which overlies the front side of the cover plate so as to cover the entire surface of the cover plate; and right and left warm-cool air supply sections arranged side by side on the rear face of the cover plate in a horizontal direction, with the opening lying in between, for feeding warm air or cool air from an open hole, which is formed so as to be located at the lower end side of a space created between the cover plate, as well as the back cover body, and the front cover body, into the space.

Advantageous Effects of the Invention

According to the massage apparatus pursuant to the present invention, both of the massage mechanism and the warm-cool air supply section can be housed inside the backrest, and nevertheless the thickness of the backrest, as well as the thickness of the sea, in the front-rear direction can be reduced.

MODES FOR CARRYING OUT THE INVENTION

Hereinafter, embodiments of the present invention will be described with reference to drawings.

Figure 1:
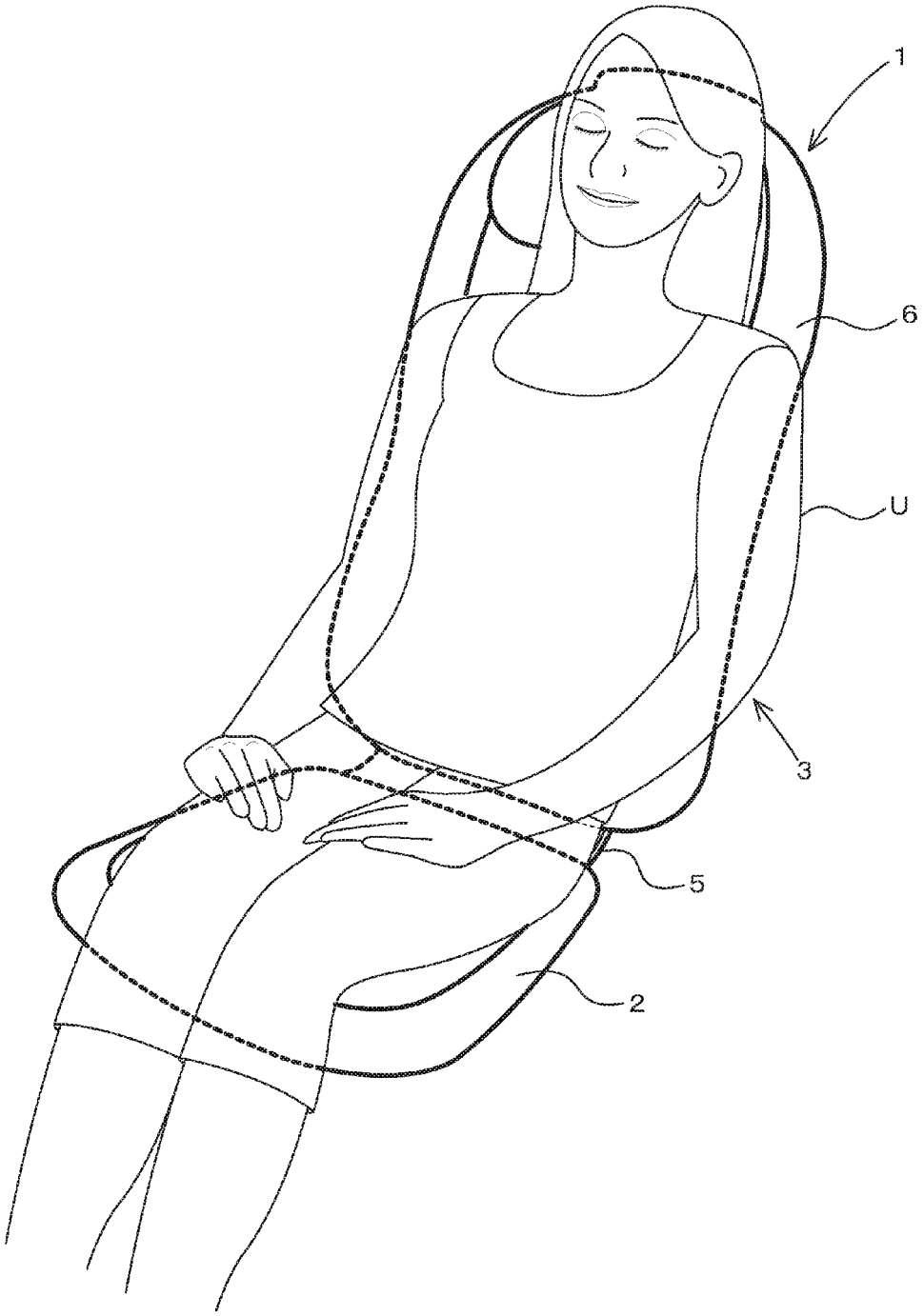
FIG. 1 is a perspective view showing how a massage apparatus is to be used.

FIGS. 1 to 8 show a massage apparatus 1 in accordance with an embodiment of the present invention. As shown in FIG. 1, the massage apparatus 1 of the embodiment is made attachable to the surface of a chair such as a sofa or a reclining chair having no massage function for giving a massage to a user U sitting in the chair.

More specifically, the massage apparatus 1 becomes usable after it is placed on a seat surface of a chair while being tied to a backrest of the chair by means of a belt or otherwise, and, the massage apparatus 1 comprises: a seat 2 on which a user U is able to sit; and a backrest 3 mounted at the rear end of the seat 2. That is, when it is desired to use the massage apparatus 1, the user U sits on the seat 2 while leaning his/her back against the backrest 3, and then operates a massage mechanism 4 disposed in one of the seat 2 and the backrest 3 for receiving a massage.

In the massage apparatus 1 pursuant to the present invention, it is essential only that the massage mechanism 4 be disposed in at least any one of the backrest 3 and the seat 2. In the following description as to the present embodiment, a construction in which the massage mechanism 4 is disposed only in the backrest 3 (that is, the seat 2 is free of the massage mechanism 4) exemplifies the massage apparatus 1 pursuant to the present invention.

Moreover, for convenience in illustrating the invention, in the following description, a horizontal direction in FIGS. 3 and 5 will be defined as "right-left direction" in explaining the massage apparatus 1. Furthermore, a vertical direction in FIGS. 5 and 8 will be defined as "top-bottom direction" in explaining the massage apparatus 1. In addition, a direction of drilling through the paper sheet with FIG. 5 printed on it, as well as a horizontal direction in FIG. 8, will be defined as "front-rear direction" or "widthwise direction" in explaining the massage apparatus 1. The definitions of the above directions conform to a front-rear direction, a right-left direction, and a top-bottom direction based on the sight of the user U sitting in the massage apparatus 1.

Next, the seat 2 and the backrest 3 constituting the massage apparatus 1 of the present embodiment will be described.

As shown in FIG. 1, the seat 2 provided in the massage apparatus 1 of the present embodiment is given the shape of a flat plate on which the user U is able to sit, and is therefore made of a material having cushioning capability such as a sponge. The edge of the rear side of the seat 2 is formed with a rearwardly-extending strip-like coupling portion 5 whose width is smaller than the widthwise dimension of the seat 2. The backrest 3 is, at its lower end side, coupled to the rear end of the coupling portion 5. Thus, the seat 2 and the backrest 3 are coupled to each other via the coupling portion 5.

The backrest 3 is a member mounted at the rear end of the seat 2 in order to support the back of the user U, which is made of the same material as that used for the seat 2, and has the shape of a vertically elongated plate so as to cover the entire area of user's back. Moreover, the backrest 3 has its upper end side made rockable back and forth about the lower end side coupled to the seat 2 acting as a pivotal point, so that the backrest 3 can be freely changed in rocking position between a reclining position where the backrest 3 is tilted with its upper end side located behind the lower end side and an upstanding position where the backrest 3 stands up with its upper end side located substantially immediately above the lower end side.

As has already been described, the backrest 3 is provided with the massage mechanism 4 for performing a massage on a part to be massaged at the back of the user U. More specifically, the backrest 3 comprises: a backrest cover 6 having the shape of a downwardly opening bag; and a platy massage apparatus main body 7 which is housed inside the backrest cover 6. The above-described massage mechanism 4 is incorporated in the platy massage apparatus main body 7.

Figure 2:
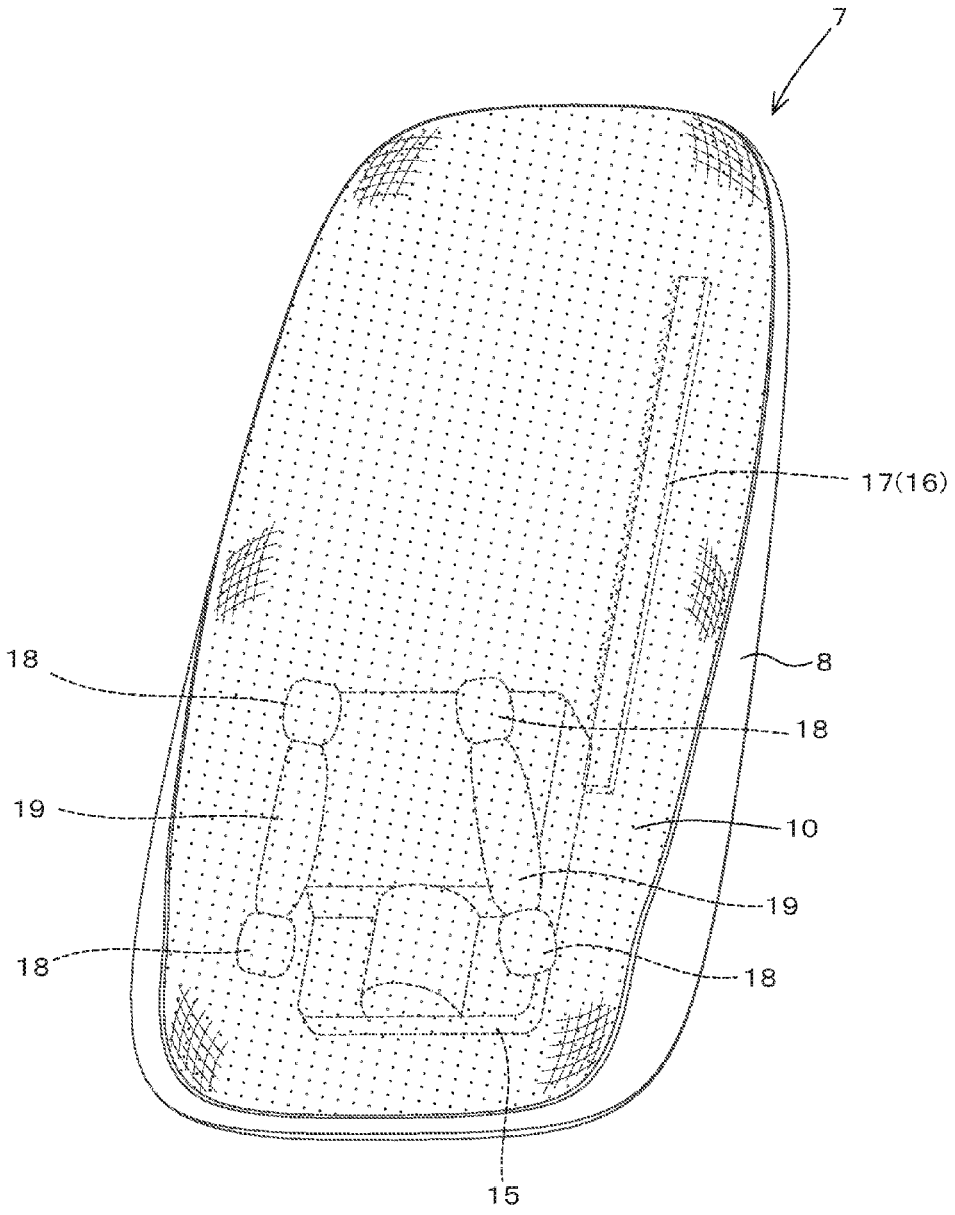
FIG. 2 is a perspective view showing a massage apparatus main body of the massage apparatus.
Figure 3:
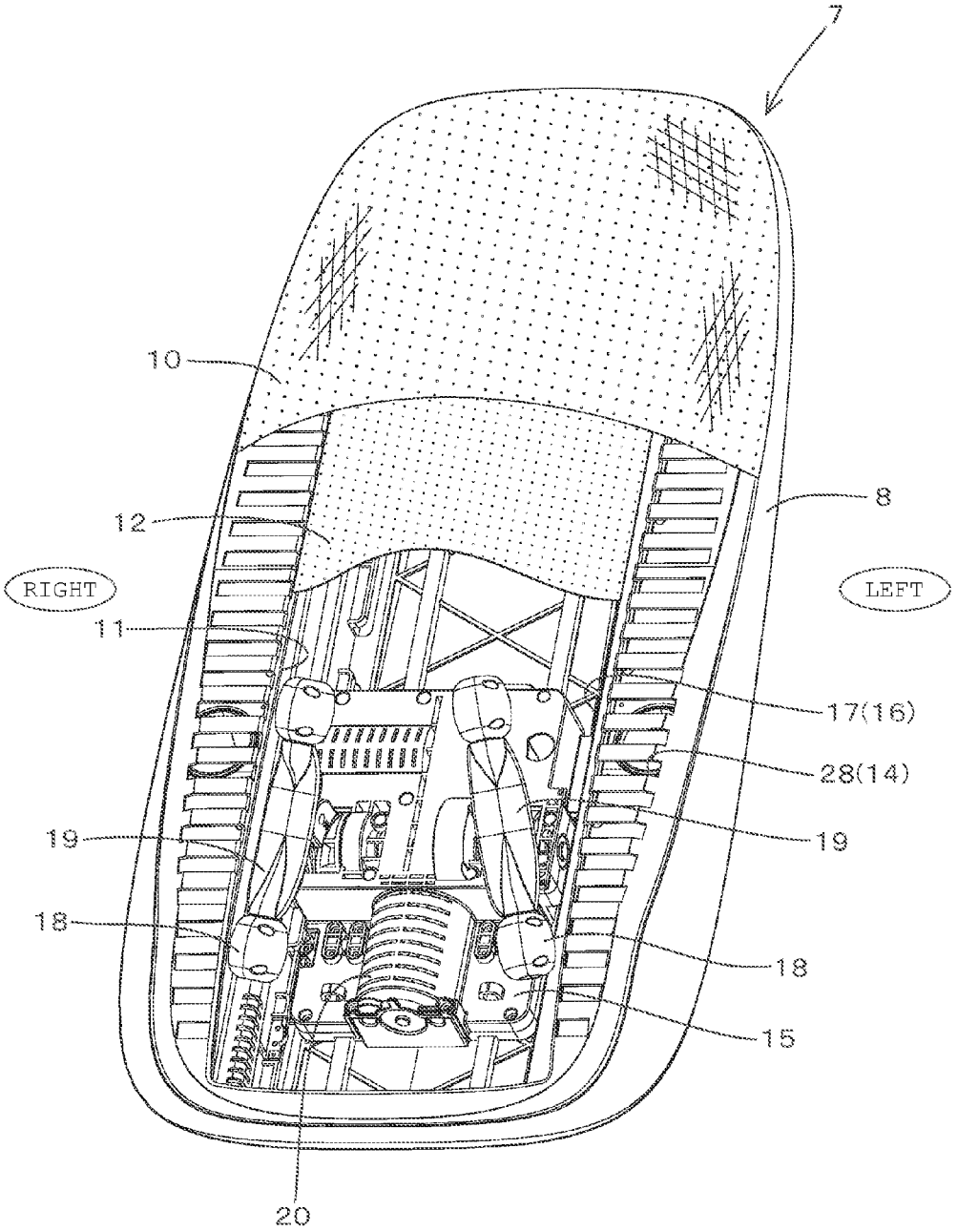
FIG. 3 is a perspective view of the massage apparatus shown in FIG. 2, with a front cover body and part of a back cover body removed.
Figure 4:
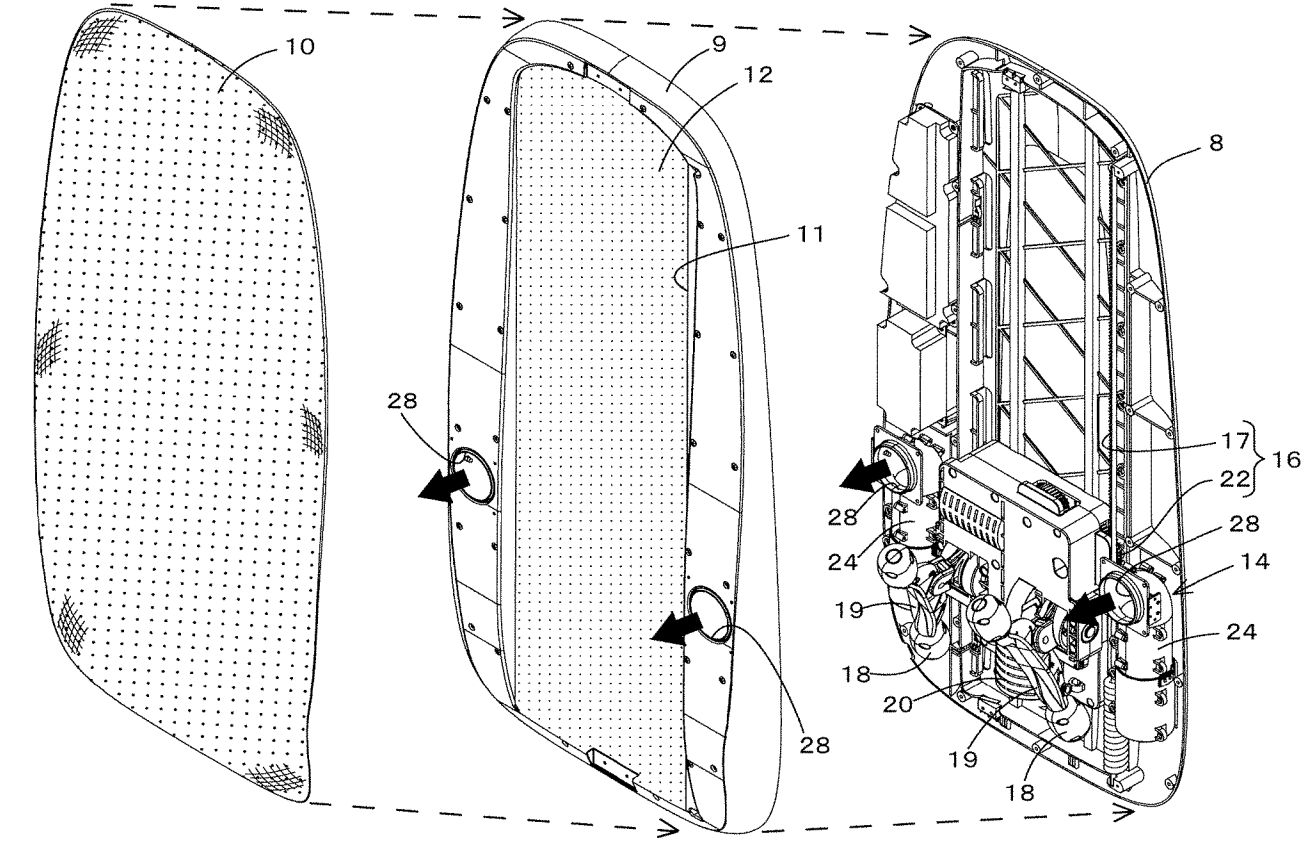
FIG. 4 is an exploded view showing the massage apparatus main body of the massage apparatus in a disassembled condition.

As shown in FIGS. 2 to 4, the massage apparatus main body 7 is shaped like a vertically elongated plate in appearance in which the thickness thereof in the front-rear direction is smaller than the widthwise thickness thereof, and is disposed in upstanding condition while pointing in the front-rear direction.

As shown in FIG. 4 in detail, the massage apparatus main body 7 is composed of a stack of three members, namely a base plate 8 (a member depicted in the right-hand part of FIG. 4), a cover plate 9 (a member depicted in the middle part of FIG. 4), and a front cover body 10 (a member depicted in the left-hand part of FIG. 4) that are sequentially arranged in rear-to-front order in the front-rear direction.

That is, the base plate 8 has the form of a plate which is gently curved backwardly, and the front cover body 10 has the form of a plate which is gently curved forwardly, so that a space can be created upon stacking of the base plate 8 and the front cover body 10. Moreover, the cover plate 9 is interposed between the base plate 8 and the front cover body 10 so as to divide the internal space of the massage apparatus main body 7 into two spaces, namely a front space and a rear space, as well as to cover the base plate 8 from its front side.

The cover plate 9 is a platy member which is able to cover the entire area of the front face of the base plate 8. An opening 11 is formed centrally of the cover plate 9 in the widthwise direction. The opening 11 is fitted with a back cover body 12 for blocking the opening 11 closely. That is, the above-described cover plate 9 and the front cover body 10, in other words, the back cover body 12 and the front cover body 10 constitute a two-layer structure, and, a space 13 capable of storage of warm air or cool air can be created between the two layers of the two-layer structure.

Moreover, the cover plate 9 has, at its rear face, a warm-cool air supply section 14 capable of supply of warm air or cool air, and, this warm-cool air supply section 14 is connected so as to feed warm air or cool air into the above-described interlayer space 13 of the two-layer structure.

A massage unit 15 is housed in a location on the base plate 8, in other words, a location between the base plate 8 and the cover plate 9. The massage unit 15 comprises: a massage mechanism 4 for massaging a body part to be massaged of the user U; and vertically moving means 16 for guiding the massage unit 15 in vertical movement within the massage apparatus main body 7.

Next, the base plate 8, the cover plate 9, the front cover body 10, the back cover body 12, the massage mechanism 4, the vertically moving means 16, and the warm-cool air supply section 14 constituting the massage apparatus main body 7 as described hereinabove are each described in detail.

Figure 5:
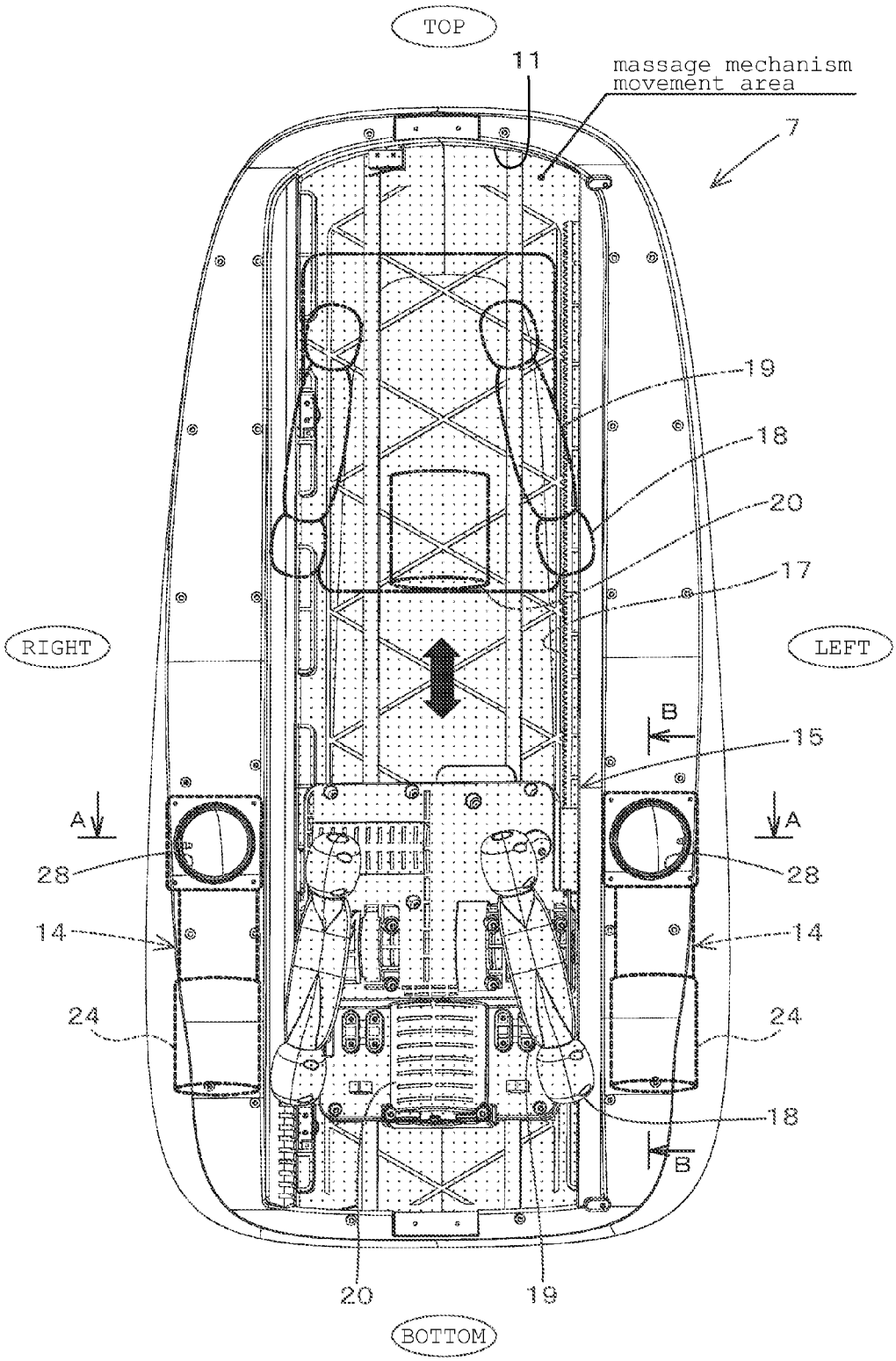
FIG. 5 is a front view showing a movement area of a massage mechanism.

As shown in FIGS. 3 to 5, the base plate 8 is made to have a small thickness in the front-rear direction, is shaped like a vertically elongated plate, and is gently curved backwardly in appearance. The midportion of the front face of the base plate 8 is formed with a forwardly opening shallow recess. The above-described massage mechanism 4 is attached, via the vertically moving means 16, to the midportion of the front face of the base plate 8. More specifically, the base plate 8 has formed on its front face the vertically moving means 16 (rail member 17) for moving the massage mechanism 4 along the direction of the length of the base plate 8 (vertical direction). The vertically moving means 16 allows the above-described massage unit 15 to move along the rail member 17 in the vertical direction.

The cover plate 9 is, like the base plate 8, given the shape of a vertically elongated plate, and is able to block the forward-facing opening of the base plate 8. The cover plate 9 has formed in its widthwise midportion the opening 11 extending along the direction of the length of the cover plate 9 (vertical direction). More specifically, the opening 11 has an opening width which is narrower than the width of the cover plate 9 in the horizontal direction, and also has an opening size which is slightly smaller than the vertical size of the cover plate 9 in the vertical direction. That is, when viewed from the front, the opening 11 has the shape of a vertically elongated strip, and, the above-described massage unit 15 is moved vertically along this vertically elongated opening 11. In other words, the opening 11 represented by the dotted area of FIG. 5 serves as a movement area; that is, the range of up-and-down movement of the massage mechanism 4.

As has already been described, the massage unit 15 comprises: the massage mechanism 4 for massaging a to-be-massaged body part of the user U; and the vertically moving means 16 for guiding the massage unit 15 in vertical movement within the massage apparatus main body 7.

It is noted that, as the massage mechanism 4 provided in the massage unit 15, a mechanism capable of performing at least one of kneading massage, tapping massage, finger-pressure massage, and vibratory massage on the to-be-massaged part of the back of the user U is utilized. Moreover, various types of driving systems, including a mechanical driving system for driving a massager 18 in a mechanical manner and an air driving system for driving it in a pneumatic manner, can be adopted for use in the massage mechanism 4.

In the following description as to the massage mechanism 4 pursuant to the present invention, a massage mechanism which performs "kneading massage" by driving the massager 18 in a mechanical manner exemplifies the massage mechanism 4.

As shown in FIGS. 3 and 4, the massage mechanism 4 of the present embodiment comprises: a pair of right and left arm members 19; massagers 18 attached to the lengthwise ends, respectively, of each of the arm members 19; and a driving section 20 for moving the arm members 19 close to and away from each other so that a to-be-massaged part can be massaged while being held between the massagers 18. Among these members constituting the massage mechanism 4, the arm members 19 and the massagers 18 are situated ahead of the opening 11 of the cover plate 9 described previously. On the other hand, the driving section 20 is situated behind the opening 11. That is, the massage mechanism 4 is installed so that the arm members 19 and the massagers 18 protrude forward from the opening 11.

Moreover, the massage mechanism 4 exemplified in the drawings has a total of four massagers 18 (kneading balls), and, among the four massagers 18, vertically arranged two massagers 18, namely an upper massager 18 and a lower massager 18 are coupled to each other via a single arm member 19. The arm member 19 is disposed on each of the right and left sides, and, these right-hand and left-hand arm members 19 can be rocked (driven) so as to move close to and away from each other in the horizontal direction by the driving section 20 disposed behind the opening 11. The four massagers 18 and the arm members 19 lie within the earlier described movement area as viewed from the front even during the rocking motion of the arm members 19.

The above-described driving section 20 has a non-illustrated rotation shaft extending along the horizontal direction, and also has a motor 21 which rotatably drives the rotation shaft. The rotation shaft is fitted with a cylindrical eccentric drive body in coaxial relation, and, the eccentric drive body has a cam groove formed on the outer peripheral surface thereof so as to run around an axis inclined with respect to the above-described rotation shaft. With the base end side of the arm member 19 coupled to the cam groove, the arm member 19 is guided, while being restrained against co-rotation, along the cam groove, thereby imparting rocking motion to the arm member 19 in the horizontal direction.

The massager 18 employed in the massage mechanism 4 exemplified in the drawings is disposed in a manner such that a line of continuation of the arm member 19 extending in its protruding direction passes through the interior of the massager 18. Each massager 18 is attached to the arm member 19 for free rotation about an axis extending along the protruding direction.

The massager 18, the arm member 19, and the driving section 20 thus far described are mounted in the massage unit 15 in casing form. The massage unit 15 can be moved in the vertical direction by the vertically moving means 16 as will hereafter be described.

Figure 6:
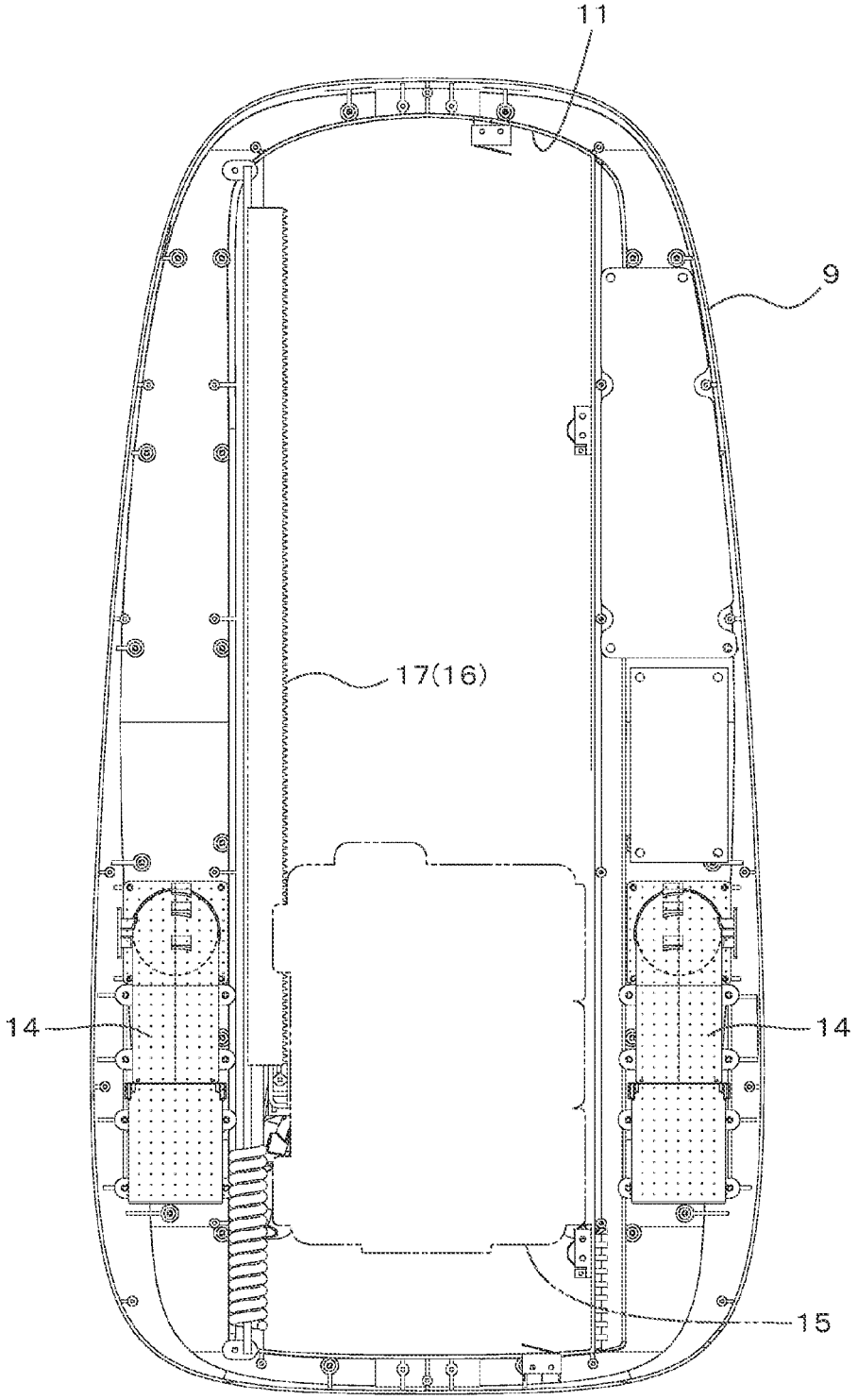
FIG. 6 is a rear view of a cover plate.

As shown in FIGS. 4 to 6, the vertically moving means 16 comprises: the earlier described rail member 17 attached to the base plate 8; and an up-and-down driving section 20 for moving the massage unit 15 along the rail member 17.

More specifically, the rail member 17 for guiding the massage unit 15 in vertical movement is disposed on the left end side of the opening 11. The right edge of the rail member 17 is formed with an array of rack teeth placed linearly along the vertical direction. Meanwhile, the up-and-down driving section 20 incorporates a spur gear 22 which meshes with the rack teeth of the rail member 17. Thus, upon rotation of the spur gear 22 in forward and reverse directions by means of the driving motor 21, the massage mechanism 4 (viz., the massage unit 15) is moved vertically along the rail member 17.

The provision of the above-described vertically moving means 16 makes it possible to render the massage unit 15 having the built-in massage mechanism 4 vertically movable along the opening 11. That is, the vertically extending opening 11 is defined as "massage mechanism 4 movement area" of the present embodiment.

The back cover body 12, which is a cloth-made member or a sheet-like member having an area large enough for the closure of the above-described opening 11 of the cover plate 9, covers the opening 11 of the cover plate 9 tightly without producing any clearance, and partitions the cover plate 9 so as to create two spaces, namely a rear space and a front space.

Figure 7:
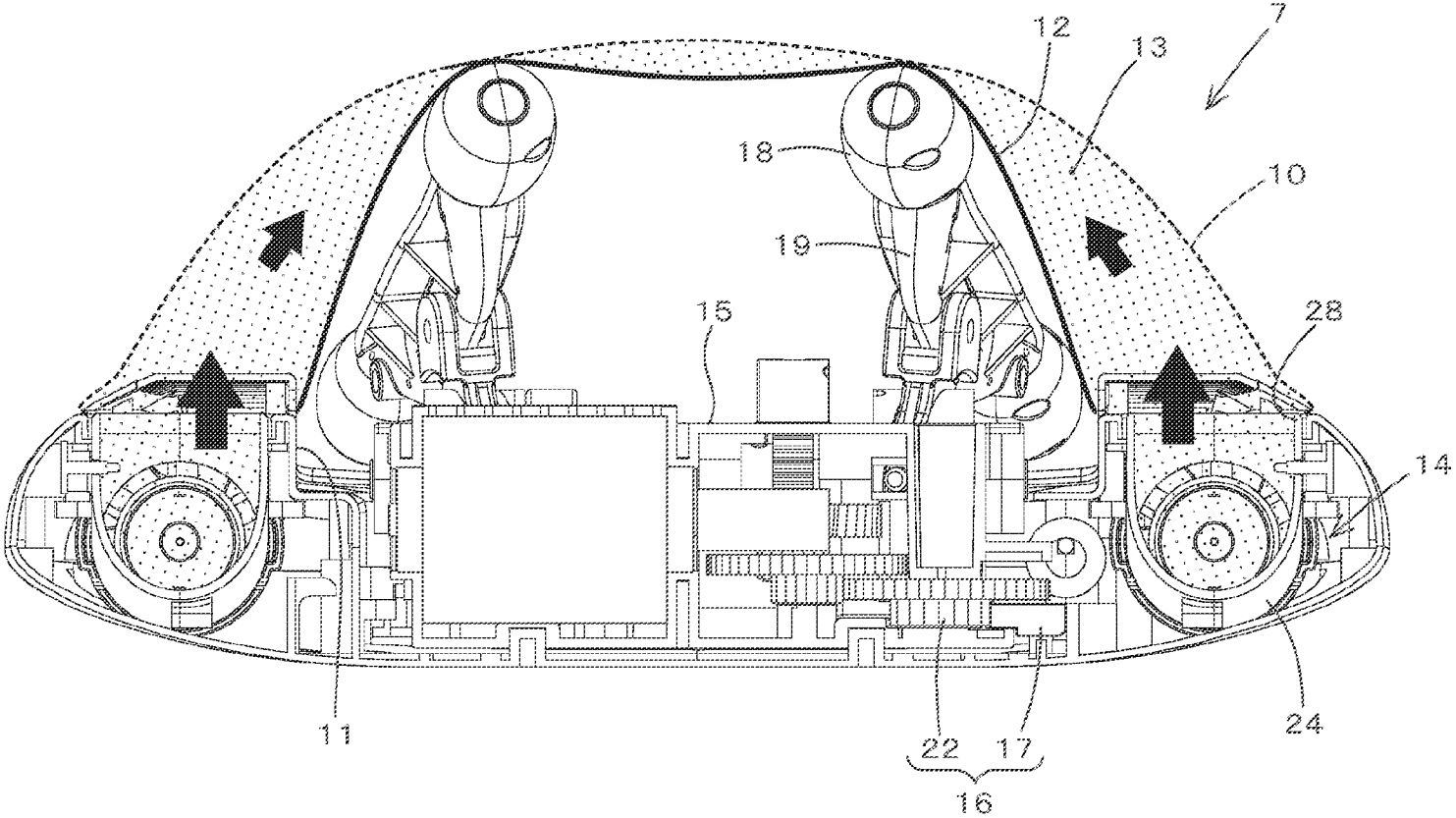
FIG. 7 is a sectional view taken along the line A-A of FIG. 5.

As represented by a thick line in FIG. 7, a readily deformable material, such as rubber, is used for the cloth or sheet constituting the back cover body 12. That is, as has already been described, since the arm member 19 and the massager 18 constituting the massage mechanism 4 are disposed so as to protrude forward from the opening 11 of the cover plate 9, it follows that the back cover body 12 is attached to the opening 11 with great flexure toward the front so as to cover the forwardly-protruding arm member 19 and massager 18 from the front.

Moreover, a material which is impervious to warm air or cool air supplied from the warm-cool air supply section 14 as will hereafter be described is used for the cloth or sheet constituting the back cover body 12. In this way, by using a material which is impervious to air such as warm air or cool air for the back cover body 12, it is possible to prevent air from circulating between the region ahead of the cover plate 9 and the region behind the cover plate 9, and thereby utilize a space between the cover plate 9 and the base plate 8 and a space between the cover plate 9 and the front cover body 10 as mutually isolated spaces between which air is not allowed to circulate. It is also possible to avoid that warm air reaches the massage mechanism 4 situated on the back side of the cover plate 9.

For example, a rubber sheet such as a silicon rubber sheet, a member in the form of a sheet made of synthetic resin such as polyolefin, or a member in the form of a nonwoven fabric made of the aforementioned material may be used for the back cover body 12.

As indicated by a dotted line in FIG. 7, the front cover body 10 is a platy member which is gently curved forwardly in appearance, is designed so that the thickness thereof in the front-rear direction is smaller than the widthwise thickness thereof, and is given the shape of a vertically elongated plate. Moreover, the front cover body 10 has an area large enough to cover the entire surface of the front side of the above-described cover plate 9.

Moreover, in contrast to the back cover body 12, the front cover body 10 is made of a material having permeability to warm air or cool air supplied from the warm-cool air supply section 14, in other words, an air-permeable material, and therefore allows warm air or cool air fed into the region between it and the above-described back cover body 12 to pass therethrough, so that the air can be supplied to a to-be-massaged part of the back of the user U sitting in the apparatus while leaning his/her back against the backrest 3. For example, a coarsely-woven fabric made of synthetic fibers may be used for the front cover body 10.

The massage apparatus 1 pursuant to the present invention is characterized by having the warm-cool air supply section 14 capable of feeding warm air or cool air into the earlier described interlayer space 13 of the two-layer structure existing between the front cover body 10 and the back cover body 12 (in other words, the space between the front cover body 10 and the cover plate 9), and, this warm-cool air supply section 14 is located outside of the movement area which is the range of up-and-down movement of the massage mechanism 4. Next, the warm-cool air supply section 14 featuring the massage apparatus 1 pursuant to the present invention will be described.

As shown in FIGS. 5 to 8, the warm-cool air supply section 14 is capable of feeding warm air and cool air into the interlayer space of the two-layer structure comprising the front cover body 10 and the back cover body 12 in a selective manner in accordance with applications. For example, when it is desired to have a massage in winter months or to have heat treatment to alleviate kink or stiffness, the warm-cool air supply section 14 is operated to feed warm air into the interlayer space of the two-layer structure to warm up a to-be-treated part. On the other hand, in summer season or after taking a bath, the warm-cool air supply section 14 is operated to feed cool air (non-heated air) into the interlayer space of the two-layer structure to allow the user to have a massage while cooling his/her body down comfortably.

More specifically, the warm-cool air supply section 14 comprises: an air guide pipe 24 for taking therein air existing in the space created between the base plate 8 and the cover plate 9, and guiding the taken air to enter the space 13 created between the cover plate 9 and the front cover body 10; a blower fan 25 for delivering air along the air guide pipe 24; a fan motor 26 for rotatably driving the blower fan 25; and a heater 27 for heating air delivered thereto by the blower fan 25 appropriately in the case of feeding warm air.

As shown in FIGS. 4 to 6, the above-described air guide pipe 24 is a tubular member disposed so as to stand vertical, which has a hollow interior for air delivery. Moreover, the lower end of the air guide pipe 24 is opened toward the lower end of the space between the base plate 8 and the cover plate 9 for taking air existing between the base plate 8 and the cover plate 9 and directing the air in an upward direction. Furthermore, the air guide pipe 24 is bent forward substantially perpendicularly at its intermediate part for guiding the air in the middle of upward movement to change its traveling direction so as to be directed in a forward direction. On the other hand, the upper end of the air guide pipe 24 is opened into an intermediate part of the cover plate 9 in the vertical direction (is communicated with an open hole 28 (supply hole 28) formed in the vertical intermediate part of the cover plate 9), and is attached to the surface of the cover plate 9 by means of a bolt or otherwise. That is, the air guide pipe 24 is capable of delivering air taken therein from the space at the rear of the cover plate 9 into the space 13 located ahead of the cover plate 9, in other words, the space 13 between the cover plate 9 and the front cover body 10.

The blower fan 25 is disposed inside the air guide pipe 24. The fan motor 26 is disposed alongside the blower fan 25, and, the blower fan 25 is rotatably driven by the fan motor 26, thereby achieving force-feeding of air taken in the air guide pipe 24. The heater 27 is, like the fan motor 26, disposed inside the air guide pipe 24, but is situated downstream of the fan motor 26 in the direction of air delivery. In the heater 27, in the case of feeding warm air, air delivered by the blower fan 25 can be heated appropriately.

That is, in the warm-cool air supply section 14, as indicated by arrows in FIG. 7, air sucked from the inlet of the air guide pipe 24 is delivered to the heater 27 by the blower fan 25, and then, the air is heated appropriately by the heater 27 so that warm air can be fed into the interlayer space of the two-layer structure, or is fed directly into the space as cool air without being heated by the heater 27.

The above-described warm-cool air supply section 14 comprising the air guide pipe 24, the blower fan 25, the fan motor 26, and the heater 27 is attached to the rear face of the cover plate 9. The warm-cool air supply section 14 is disposed on each of the right and left sides of the rear face as separate sets. More specifically, there are provided two separate warm-cool air supply sections 14 that are arranged on the cover plate 9 so as to lie at the left side and the right side, respectively, of the opening 11, so that warm air or cool air can be delivered from outside the opening 11. That is, as has already been described, since the opening 11 serves as the movement area which is the range of up-and-down movement of the massage mechanism 4, it can also be said that the warm-cool air supply section 14 is located outside of the movement area which is the range of up-and-down movement of the massage mechanism 4.

Thus, in the case of placing the warm-cool air supply section 14 outside of the massage mechanism 4 movement area, the massage mechanism 4 movement area and the location of placement of the warm-cool air supply section 14 can be separated from each other when viewed from the front, wherefore positional interference will not arise between them. That is, even when the arm member 19 and the massager 18 constituting the massage mechanism 4 are rocked or the massage unit 15 fitted with the massage mechanism 4 is moved in the vertical direction, it never occurs that the arm member 19 and the massager 18 are brought into contact with the warm-cool air supply section 14. Accordingly, the provision of the warm-cool air supply section 14 for warming up and cooling down a to-be-massaged part will not impose any restriction on massage action.

Figure 8:
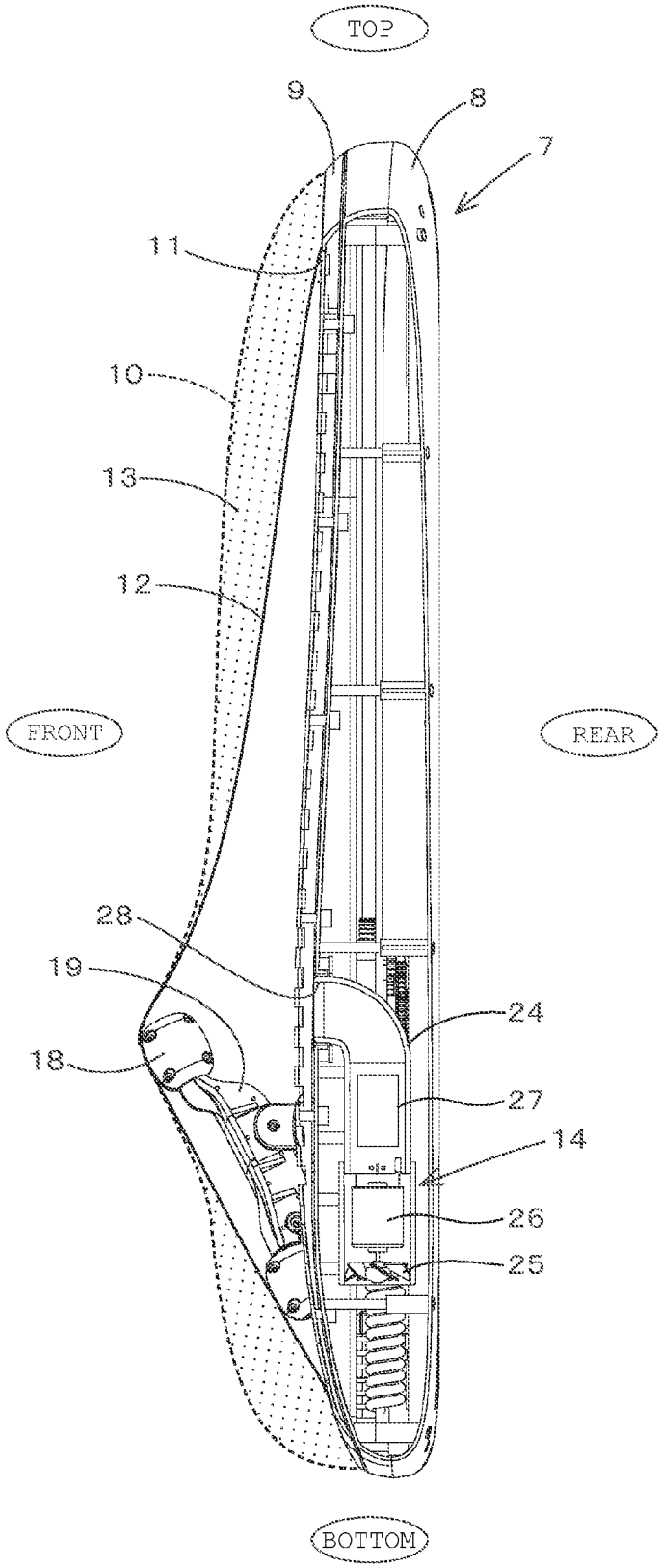
FIG. 8 is a sectional view taken along the line B-B of FIG. 5.

Moreover, as shown in FIG. 8, the above-described warm-cool air supply section 14 is disposed in overlapping relation with the range of up-and-down movement of the massage mechanism 4 as seen in side view. That is, when the backrest 3 is viewed laterally, the warm-cool air supply section 14 is disposed in overlapping relation with the rail member 17 of the vertically moving means 16 for moving the massage mechanism 4 up and down, expressed differently, disposed in the same position as the rail member 17 in the front-rear direction. In this case, in contrast to a case where the warm-cool air supply section 14 and the vertically moving means 16 are arranged so as to be stacked on top of each other in the front-rear direction, both of the massage mechanism 4 and the warm-cool air supply section 14 are housed inside the backrest 3, and nevertheless the thickness of the backrest 3 in the front-rear direction can be reduced.

As described heretofore, in the massage apparatus 1 of the present embodiment, the backrest 3 has its front side made to have a two-layer structure, and is provided with the warm-cool air supply section 14 capable of feeding warm air or cool air into the interlayer space 13 of the two-layer structure. Moreover, the massage mechanism 4 can be moved up and down along the direction of the length of the backrest 3, and, the above-described warm-cool air supply section 14 is located outside of the movement area which is the range of up-and-down movement of the massage mechanism 4. Accordingly, the warm-cool air supply section 14 is free from positional interference with the massage mechanism 4, and therefore, even if the thickness of the backrest 3 is reduced, all of these components can be housed properly inside the backrest 3. That is, in the massage apparatus 1 of the present embodiment, both of the massage mechanism 4 and the warm-cool air supply section 14 can be housed inside the backrest 3, and nevertheless the thickness of the backrest 3, as well as the thickness of the seat 2, in the front-rear direction can be reduced.

More specifically, the massage apparatus 1 of the present embodiment comprises: the platy base plate 8 having the massage mechanism 4 disposed centrally of the forward-facing surface thereof in the widthwise direction for free movement in the vertical direction (lengthwise direction); the cover plate 9 shaped like a plate which can overlie the front face of the base plate 8, and in which that part thereof which corresponds to the massage mechanism 4 movement area is formed as the opening 11; and the front cover body 10 which overlies the front side of the cover plate 9 so as to cover the entire surface of the cover plate 9. The back cover body 12 is attached to the opening 11 of the cover plate 9.

As described previously, there are provided the paired right-hand and left-hand warm-cool air supply sections 14 arranged side by side on the rear face of the cover plate 9 in the horizontal direction, with the opening 11 lying in between. Each of the warm-cool air supply sections 14 is designed to feed, through the open hole 28 formed so as to face the space 13 created between the cover plate 9, as well as the back cover body 12, and the front cover body 10, warm air or cool air into this space 13. The open hole 28 is located slightly below a midpoint of the space 13 in the vertical direction, so that warm air or cool air can be fed into the space 13 uniformly in the vertical direction.

The warm-cool air supply section 14, which is attached to the rear face of the cover plate 9, has the form of the cylindrical air guide pipe 24 having the heater 27 and the blower fan 25 therein. The upper end of the air guide pipe 24 communicates with the open hole 28. The lower end of the air guide pipe 24 is opened downwardly so as to serve as an air admission port. The level of the upper end of the massage mechanism 4 in a state of being set at a lowermost position in the movement area is substantially equal to the level of the upper end of the air guide pipe 24, and the level of the lower end of the massage mechanism 4 in a state of being set at a lowermost position in the movement area is substantially equal to the level of the lower end of the air guide pipe 24. In other words, the warm-cool air supply section 14 is located in the lower part of the movement area.

It should be understood that the scope of the present invention is indicated by the appended claims rather than the foregoing description, and all changes that come within the meaning of and the range of equivalency of the claims are intended to be embraced therein.

Moreover, the embodiments as set forth hereinabove are considered in all respects as illustrative only and not restrictive. Particularly, as to particulars that are not explicitly specified in the embodiments as disclosed hereinabove, for example, as to working conditions, operating conditions, relevant parameters, and the dimensions, weights, and volumes of constituent components, values that do not depart from the scope of the invention to be fulfilled by those skilled in the art and are easily conceivable by persons having ordinary skill in the art are adopted.

EXPLANATION OF REFERENCE SYMBOLS

1 massage apparatus
2 seat
3 backrest
4 massage mechanism
5 coupling portion
6 backrest cover
7 massage apparatus main body
8 base plate
9 cover plate
10 front cover body
11 opening
12 back cover body
13 space
14 warm-cool air supply section
15 massage unit
16 vertically moving means
17 rail member
18 massager
19 arm member
20 driving section
21 motor
22 spur gear
23 air guide pipe
25 blower fan
26 fan motor
27 heater
28 open hole (supply hole)
U user

The invention claimed is:

1. A massage apparatus comprising:

a backrest for supporting user's back; and a massager disposed inside the backrest for producing massage action on the user's back, said backrest having its front side with a two-layer structure, and being provided with a warm-cool air supply section capable of feeding warm air or cool air into an interlayer region of said two-layer structure, said massager being configured to move up and down along a direction of length of said backrest, said warm-cool air supply section being located outside of a movement area of the massager, said movement area of said massager having a shape of an elongated strip that extends in the length direction, said warm-cool air supply section being disposed on at least a right side or a left side of said movement area, said two-layer structure comprising a front cover body constituting a front face of said backrest and a back cover body disposed in a state of overlying a back side of the front cover body, the interlayer region is configured to store warm air or cool air created between said front cover body and said back cover body, said warm-cool air supply section being connected to the interlayer region and is configured to feed warm air or cool air into said interlayer region, said warm-cool air supply section including a blower fan, a fan motor, and a heater, the blower fan delivering air to the heater to produce heated air and to feed the heated air into the interlayer region of the two-layer structure, and when viewed from a lateral direction, the warm-cool air supply section, including the blower fan, the fan motor, and the heater, is located in overlapping relation with the movement area of the massager, wherein the massage apparatus further comprises a cover plate being plate shaped and overlying a front face of the massager, the cover plate being provided with an opening at a location corresponding to the movement area of the massager, wherein the warm-cool air supply section includes right and left warm-cool air supply sections being disposed on at least either of a right side and a left side of the opening on a rear face of the cover plate in a horizontal direction, with said opening lying in between the right and left warm-cool air supply sections, wherein the back cover body is attached to the opening of said cover plate, wherein the front cover body overlies the cover plate to cover an entire front side of the cover plate, wherein the right and left warm-cool air supply sections are configured to feed warm air or cool air from a respective open hole of the cover plate, and wherein the open holes of the right and left warm-cool air supply sections are located at a lower end side of the cover plate.

2. The massage apparatus of claim 1, wherein the warm-cool air supply section is located in a lower part of the movement area.

3. The massage apparatus of claim 2, wherein the back cover body is made of a material which is impervious to warm air or cool air supplied from said warm-cool air supply section.

4. The massage apparatus of claim 1, wherein the back cover body is made of a material which is impervious to warm air or cool air supplied from said warm-cool air supply section.

* * * * *